US008668315B2

(12) United States Patent
Tamaki

(10) Patent No.: US 8,668,315 B2
(45) Date of Patent: Mar. 11, 2014

(54) LIQUID EJECTING APPARATUS

(71) Applicant: Shuichi Tamaki, Nagoya (JP)

(72) Inventor: Shuichi Tamaki, Nagoya (JP)

(73) Assignee: Brother Kogyo Kabushki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/630,409

(22) Filed: Sep. 28, 2012

(65) Prior Publication Data

US 2013/0135374 A1 May 30, 2013

(30) Foreign Application Priority Data

Nov. 30, 2011 (JP) ..... 2011-263005

(51) Int. Cl.
*B41J 2/175* (2006.01)
*B41J 2/19* (2006.01)

(52) U.S. Cl.
USPC ..... 347/85; 347/92

(58) Field of Classification Search
USPC ..... 347/84, 85, 86, 92
See application file for complete search history.

(56) References Cited

U.S. PATENT DOCUMENTS 8,292,412 B2 * 10/2012 Tamaki ..... 347/85
8,454,138 B2 * 6/2013 Tamaki ..... 347/85
2011/0234713 A1 * 9/2011 Tamaki ..... 347/85
2013/0021419 A1 * 1/2013 Tamaki ..... 347/93
2013/0147879 A1 * 6/2013 Hays et al. ..... 347/44

FOREIGN PATENT DOCUMENTS

JP 2004-249616 9/2004
JP 2005-074627 3/2005

OTHER PUBLICATIONS

Computer-generated English-language translation of Japanese Laid-Open Patent Publication Application No. 2005-074627, published Mar. 24, 2005.
Computer-generated English-language translation of Japanese Laid-Open Patent Publication Application No. 2004-249616, published Sep. 9, 2004.

* cited by examiner

*Primary Examiner* — Huan Tran
(74) *Attorney, Agent, or Firm* — Scully, Scott, Murphy & Presser, PC

(57) ABSTRACT

There is provided a liquid ejecting apparatus including: a main tank, a sub tank, a liquid ejecting head, a first supply channel member, a second supply channel member, and a pump device. The first liquid supply channel includes an upstream-side supply channel, and a downstream-side supply channel. The pump device includes a first chamber, a second chamber, and a transfer-force applying section. The first chamber inlet is connected to a downstream-side end portion of the upstream-side supply channel. The first chamber outlet and the second chamber inlet are connected to the transfer-force applying section. The second chamber outlet is connected to the downstream-side supply channel. The first chamber outlet is provided to an upper-end portion of the first chamber. The second chamber outlet is provided to an upper-end portion of the second chamber.

9 Claims, 10 Drawing Sheets

LIQUID EJECTING APPARATUS

CROSS REFERENCE TO RELATED APPLICATION

The present application claims priority from Japanese Patent Application No. 2011-263005, filed on Nov. 30, 2011, the disclosure of which is incorporated herein by reference in its entirety.

BACKGROUND OF THE INVENTION

1. Field of the Invention

The present invention relates to a liquid ejecting apparatus which ejects liquid droplets for recording an image onto a recording medium.

2. Description of the Related Art

Conventionally, an ink jet recording apparatus has been known to include a main tank storing ink, a sub tank storing the ink supplied from the main tank, a recording head configured to jet the ink supplied from the sub tank, a main supply channel communicating between the main tank and the sub tank, and a suction pump provided to the main supply channel. In the abovementioned ink jet recording apparatus, at the time of replacing the ink tank, there is a fear that air may enter into the suction pump through a pipe. When the suction pump is driven in a state of the air entered into the suction pump, since air and ink are stirred intensively, there is a fear that ink which includes a large amount of air bubbles is supplied to the sub tank. Moreover, when the ink flows to a nozzle of the recording head, there is a fear that a jetting failure may occur due to air bubbles.

Further, an ink jet recording apparatus has been known to include an ink tank storing ink, a sub tank storing the ink supplied from the ink tank, a hydraulic head pressure maintaining container storing the ink supplied from the sub tank, and a recording head configured to jet the ink imparted from the hydraulic head pressure maintaining container. In the abovementioned ink jet recording apparatus, at the time of replacing the ink tank, there is a fear that air may enter into connecting portions (joints) and pipes of the ink tank. When air bubbles flow up to a nozzle of the recording head, there is a fear that a blockage of the nozzle may occur due to the air bubbles. Therefore, in the abovementioned ink-jet recording apparatus, the air bubbles and the remained ink are discharged by depressurizing inside of the sub ink tank by a vacuum pump.

SUMMARY OF THE INVENTION

In the above described ink-jet recording apparatus, since it is possible to discharge air bubbles together with the remained ink, it is possible to prevent a jetting defect which may be caused due to air bubbles. However, there has been an issue of the apparatus becoming large due to use of the vacuum pump.

The present invention has been made to solve the abovementioned issue, and an object of the present invention is to provide a liquid ejecting apparatus in which, it is possible to prevent the ejecting defect which may be caused due to air bubbles, without increasing the size of the apparatus.

According to an aspect of the present teaching, there is provided a liquid ejecting apparatus including:

a main tank configured to store a liquid;

a sub tank having an atmosphere-communicating hole formed therein, and configured to store temporarily the liquid supplied from the main tank;

a liquid ejecting head having a plurality of nozzles for jetting the liquid supplied from the main tank;

a first supply channel member having a first liquid supply channel communicating between the main tank and the sub tank;

a second supply channel member having a second liquid supply channel communicating between the sub tank and the liquid jetting head; and a pump device provided to the first liquid supply channel, and configured to supply the liquid in the main tank to the sub tank, wherein the first liquid supply channel includes an upstream-side supply channel arranged toward a main-tank side of the pump device, and a downstream-side supply channel arranged toward a sub-tank side of the pump device, the pump device includes a first chamber in which a first chamber inlet and a first chamber outlet are formed, a second chamber in which a second chamber inlet and a second chamber outlet are formed, and a transfer-force applying section which is configured to apply a transfer force for transferring a liquid inside the first chamber to the second chamber, the first chamber inlet is connected to a downstream-side end portion of the upstream-side supply channel, the first chamber outlet and the second chamber inlet are connected to the transfer-force applying section, the second chamber outlet is connected to an upstream-side end portion of the downstream-side supply channel, the first chamber outlet is provided to an upper-end portion of the first chamber, in a vertical direction, and the second chamber outlet is provided to an upper-end portion of the second chamber, in the vertical direction.

In such an arrangement, the liquid which has been imparted to the first chamber accumulates at a lower portion of the first chamber, and air which has been imparted to the first chamber accumulates at an upper portion of the first chamber. Moreover, the liquid which has been imparted to the second chamber accumulates at a lower portion of the second chamber, and air which has been imparted to the second chamber accumulates at an upper portion of the second chamber. Consequently, when the transfer-force applying section is driven, firstly, the air accumulated at the upper portion of the first chamber, upon being discharged from the first chamber outlet provided to the upper-end portion of the first chamber, is imparted to the second chamber, and the air accumulated at the upper portion of the second chamber, upon being discharged from (through) the second chamber outlet provided to the upper-end portion of the second chamber, is imparted to the sub tank. When air in the first chamber is discharged completely, and the first chamber is filled up with the liquid, thereafter, the liquid in the first chamber, upon being discharged from the first chamber outlet provided to the upper-end portion of the first chamber, is imparted to the second chamber. Moreover, when the air in the second chamber is discharged completely, and the second chamber if filled up with the liquid, thereafter, the liquid in the second chamber, upon being discharged from the second chamber outlet provided to the upper-end portion of the second chamber, is imparted to the sub tank. In such manner, in the pump device, since air and liquid are discharged one after another, air and liquid are not stirred intensely, and liquid which includes a large amount of bubbles is not supplied to the sub tank and the liquid ejecting head.

According to the present invention, due to the abovementioned arrangement, it is possible to suppress an occurrence of air bubbles without letting the size of the apparatus increase, and to prevent an ejecting defect which may be caused due to the air bubbles.

DETAILED DESCRIPTION OF THE PREFERRED EMBODIMENTS

An exemplary embodiment of a liquid ejecting apparatus according to the present teaching will be described below while referring to the accompanying diagrams. In the embodiment described below, the 'liquid ejecting apparatus' according to the present teaching is applied to an ink-jet printer, and a processing liquid and an ink, are used as liquids. As a 'liquid ejecting head', a processing-liquid jetting head and an ink jet head are used.

Figure 1:
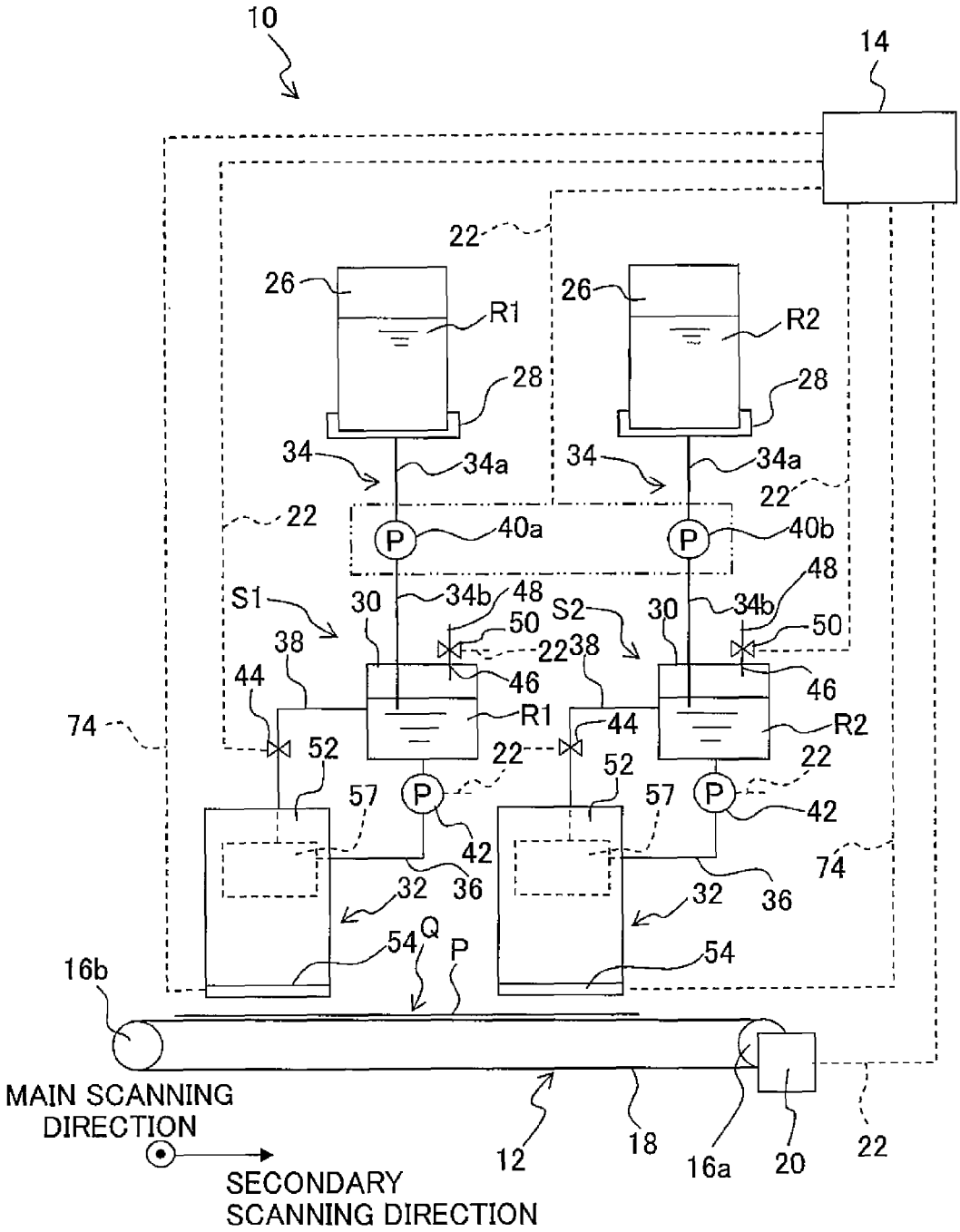
FIG. 1 is a conceptual diagram showing an overall structure of an ink jet printer according to an embodiment of the present invention.

An ink jet printer 10 is configured to fog in an image in a predetermined image forming area Q, by jetting an ink R2 after jetting a processing liquid R1 on to a surface of a paper P. As shown in FIG. 1, the ink-jet printer 10 includes a paper transporting mechanism 12 which transports the paper P in a horizontal direction to pass the image forming area Q, a first system S1 which is configured to jet the processing liquid R1, a second system S2 which is configured to jet the ink R2, and a control device 14 which carries out various arithmetic processing and control operations.

As the processing liquid R1, a processing liquid which condenses or precipitates or extracts a component of the ink R2 is used. For instance, a processing liquid which condenses pigment color is used for the ink R2 which is a pigment ink, and a processing liquid which precipitates dyestuff (dye color) is used for the ink R2 which is a dye ink. As a material of the processing liquid R1, a cationic compound, particularly, a cationic polymer and a cationic surfactant (cationic surface-active agent), and a multivalent metal salt such as a salt of calcium and a salt of magnesium can be used. When the ink R2 lands on a surface of the paper P on which at least one of these processing liquids R2 is applied, the multivalent metal salt acts on (reacts with) pigments or a dye which is a coloring agent of the ink R2, and a metal complex which is insoluble or poorly soluble is formed by condensation or precipitation. As a result, a degree of penetration of the ink R2 into the paper P is degraded, and it becomes easy to fix the ink R2 on the paper P.

The control device 14 shown in FIG. 1 includes a central processing unit (CPU), a non-volatile memory which rewritably stores various data and computer programs which are to be executed by the CPU, and a random access memory (RAM) which temporarily stores data at the time of executing a computer program. Various processing which are necessary for image processing are carried out by computer programs being executed by the CPU. The structure of the control device 14 shown here is an exemplification, and the structure of the control device 14 is not necessarily restricted to such a structure. For example, the control device 14 can include a memory such as a read only memory (ROM) and an application specific integrated circuit (ASIC), if necessary.

As shown in FIG. 1, The paper transporting mechanism 12 includes a pair of pulleys 16*a* and 16*b*, an endless belt 18 in the form of a ring which is put around the pulleys 16*a* and 16*b*, and a motor 20 which rotates one pulley 16*a*. The control device 14 is electrically connected to the motor 20 via a conductive wire 22.

As shown in FIG. 1, the first system S1 includes a main tank 26 which stores the processing liquid R1, a tank holder 28 which removably holds the main tank 26, a sub tank 30 which temporarily stores the processing liquid R1, a processing-liquid jetting head 32 having a jetting surface 60*a* in which nozzles 60 for jetting the processing liquid R1 supplied from the sub tank 30 are formed, and a processing-liquid jetting head 32 which is configured to jet the processing liquid R1 supplied from the sub tank 30 onto a paper P. Moreover, the first system Si further includes a first liquid supply channel which connects the main tank 26 and the sub tank 30, a second supply channel 36 which connects the sub tank 30 and the processing liquid jetting head 32, and a return channel 38 which connects the sub tank 30 and the processing liquid jetting head 32. Furthermore, the first system Si includes a pump unit 40*a* which is provided to the first liquid supply channel 34 and which supplies the processing liquid R1 in the main tank 26 to the sub tank 30 forcibly, a pump 42 which is provided to the second liquid supply channel 36 and which supplies the processing liquid R1 in the sub tank 30 to the processing liquid jetting head 32 forcibly, and a valve 44 which is provided to the return channel 38 and which opens and closes the return channel 38. Moreover, the control device 14 is electrically connected to the pump unit 40*a*, the pump 42, and the valve 44 via the conductive wire 22.

Figure 9:
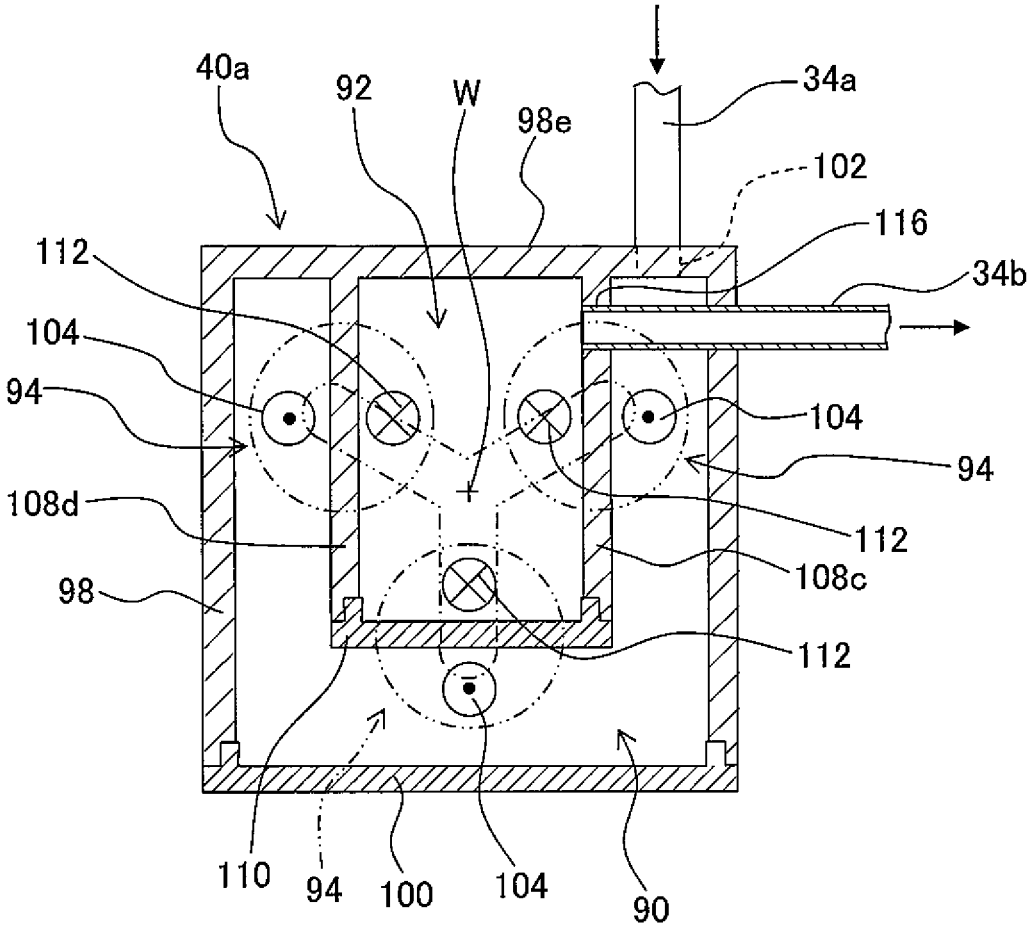
FIG. 9 is a cross-sectional view taken along a line IX-IX in FIG. 7.

As shown in FIG. 1, the first liquid supply channel 34 has an upstream-side supply channel 34*a* which is arranged at an upstream side of the pump unit 40*a*, and a downstream-side supply channel 34*b* which is arranged at a downstream side of the pump unit 40*a*. Here, as shown in FIG. 9, a downstream-side end portion of the upstream-side supply channel 34*a* is connected to an inlet of the pump unit 40*a*, or in other words, to a first chamber inlet 102 which will be described later. An upstream-side end portion of the downstream-side supply channel 34*b* is connected to an outlet of the pump unit 40*a*, or in other words, a second chamber outlet 116 which will be described later.

As shown in FIG. 1, the sub tank 30 is a container used for removing air bubbles mixed in the processing liquid R1, and an atmosphere-communicating hole (a vent) 46 is formed in an upper surface of the sub tank 30. An atmosphere-communicating tube 48 is inserted through the atmosphere-communicating hole 46. Moreover, the atmosphere-communicating tube 48 is provided with a valve 50 which opens and closes the atmosphere-communicating tube 48, and the control panel 14 is electrically connected to the valve 50 via the conductive wire 22. With the valve 50 in an open state, when air is supplied from the pump unit 40*a* to the sub tank 30, the air is separated from the processing liquid R1 at an interior of the sub tank 30, and is discharged into the atmosphere through the atmosphere-communicating tube 48.

The ink-jet printer 10 shown in FIG. 1 is a line printer, and the processing liquid jetting head 32 (FIG. 1) is provided to be extended in a direction, which is parallel to a horizontal direction and is orthogonal to a transporting direction of the paper P. The direction in which the processing liquid jetting head 32 is extended (FIG. 1) is a 'main scanning direction', and the transporting direction of paper P in the image forming area Q is a 'secondary (sub) scanning direction'.

As shown in FIG. 1, the processing liquid jetting head 32 has a head holder 52 having a substantially rectangular parallelepiped shape, which is provided to be extended in the main scanning direction, the head portion 54 which is provided to be extended in the main scanning direction, on a lower surface of the head holder 52, and a server 57 which is provided at an upper side of the head portion 54 at an interior of the head holder 52.

Figure 2:
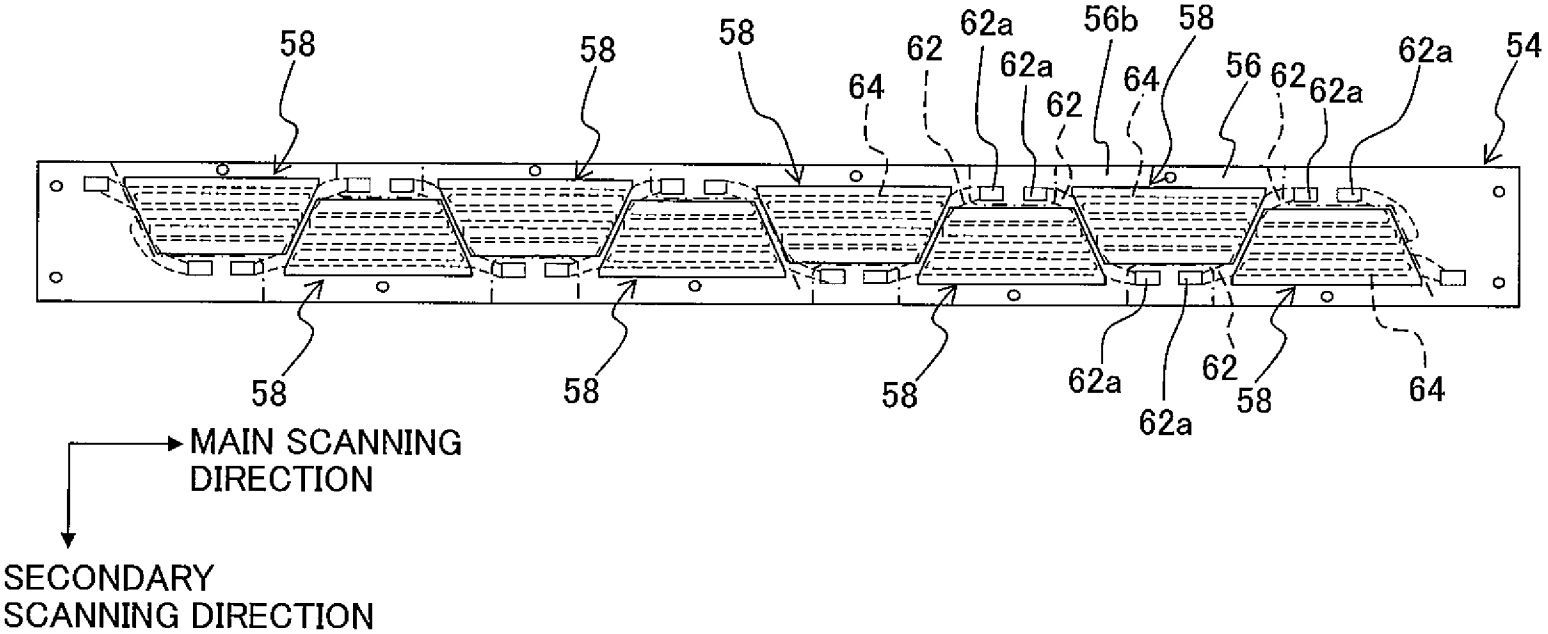
FIG. 2 is a plan view showing a structure of a head portion of a processing-liquid jetting head.
Figure 3:
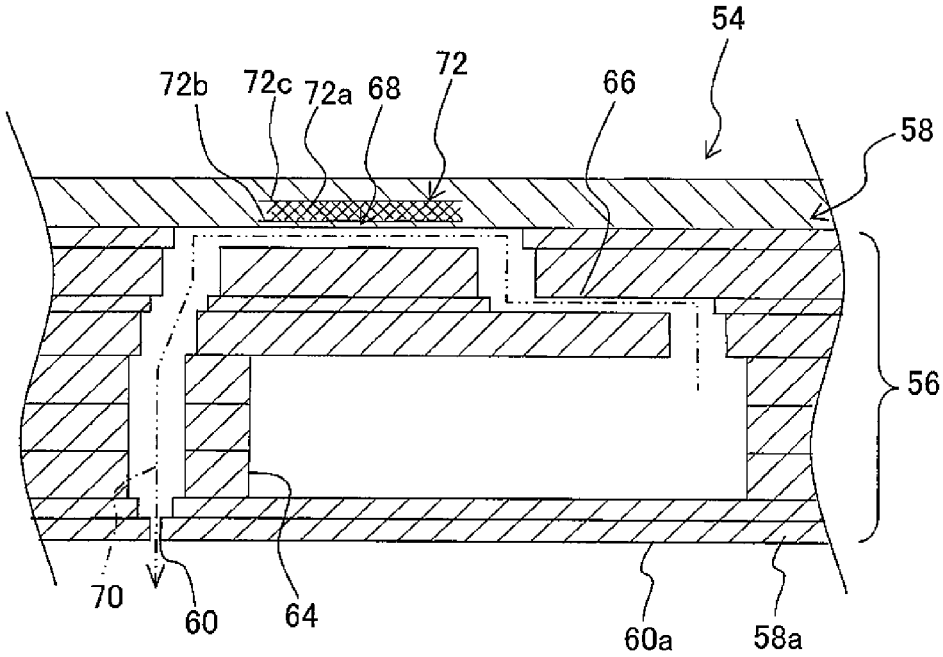
FIG. 3 is a partially enlarged cross-sectional view showing a structure of the head portion of the processing-liquid jetting head.

As shown in FIG. 2 and FIG. 3, the head portion 54 has one channel unit 56, and a plurality of actuators 58 joined to or attached to an upper surface of the channel unit 56. Eight actuators 58 are indicated in the embodiment. However, this is merely an exemplification, and the number of actuators 57 may be less than eight, or may be more than eight. As shown in FIG. 3, the channel unit 56 is formed of a stacked body which includes a plurality of metallic plates. A plurality of nozzles 60 is formed in a nozzle plate 56*a* which forms a lowermost layer of the channel unit 56. A lower surface of the nozzle plate 56*a* forms a jetting surface 60*a* in which the plurality of nozzles 60 is formed. Moreover, as shown in FIG. 3, a manifold 62 (FIG. 2), a secondary manifold 64 which communicates with the manifold 62, and a plurality of individual channels 70 extending from the secondary manifolds 64 up to the nozzles 60 via apertures 66 and pressure chambers 68 are formed at an interior of the channel unit 56. Moreover, as shown in FIG. 2, a plurality of supply ports 62*a* which communicate with the manifolds 62 is formed in an upper surface 56*b* of the channel unit 56, and a channel which is extended from a reservoir 57 (FIG. 1) is connected to the supply port 62*a*. As shown in FIG. 1, the reservoir 57 is a portion which temporarily stores the processing liquid supplied from the sub tank 30, and the second liquid supply channel 36 and the return channel 38 are connected to the reservoir 57.

As shown in FIG. 2, each actuator 58 is formed to have a substantially trapezoidal shape in a plan view. The plurality of actuators 58 is arranged side-by-side in the main scanning direction such that, upper bases (tops) and lower bases (bottoms) of the adjacent actuators 58 are in mutually opposite direction. As shown in FIG. 3, each actuator 58 has a plurality of drive sections 72 respectively, corresponding to the pressure chambers 68. The drive section 72 is indicated by grid lines in FIG. 3. Each drive section 72 has a piezoelectric layer 72*a*, and a pair of electrodes 72*b* and 72*c* which are arranged to sandwich the piezoelectric layer 72*a*. Moreover, as shown in FIG. 1, the control device 14 is electrically connected to each drive section 72 via a flexible circuit board 74 on which a driver IC (not shown) is mounted.

When a drive voltage (for example, an electrical potential difference of 28 V) is supplied between the electrodes 72*b* and 72*c* of the drive section 72 shown in FIG. 3, the piezoelectric layer 72*a* contracts in a direction orthogonal to a thickness direction of the piezoelectric layer 72*a*. Accordingly, the drive section 72 is deformed such that a portion positioned at a lower side of the piezoelectric layer 72*a* forms a projection inward of the pressure chamber 68. Accordingly, a volume of the pressure chamber 68 corresponding to that drive section 72 decreases. This state is a basic state. In the basic state, when a ground voltage (such as an electrical potential difference of 0 V) is supplied between the electrodes 72*b* and 72*c*, a contracted state of the piezoelectric layer 72*a* is released. As the contracted state of the piezoelectric layer 72*a* is released, the volume of the pressure chamber 68 returns to the original volume, and becomes larger as compared to a volume in the basic state. In such manner, when the ground voltage is supplied instantaneously between the electrodes 72*b* and 72*c* while the basic state is being maintained, the volume of the pressure chamber 68 fluctuates instantaneously according to the amplitude of the drive voltage, at a timing when the ground voltage is supplied. At this time, a discharge energy (jetting energy) is applied to the processing liquid R1 existing in the pressure chamber 68. Due to the discharge energy, the processing liquid R1 is jetted from the nozzle 60. However, when there is an air bubble near the nozzle 60, there is a fear that the discharge energy applied from the drive section 72 is absorbed by the air bubble, or that the nozzle 60 is blocked by the air bubble, and there is a fear of occurrence of a jetting defect.

As shown in FIG. 1, the pump unit 40*a* is integrated with a pump unit 40*b* of the second system S2, and forms a pump assembly 80. The pump unit 40*a* will be described later.

As shown in FIG. 1, although an object of the second system S2 is to jet the ink R2, an object of the first system S1 is to jet the processing liquid R1. Therefore, the objects are different from each other. However, the basic or concrete structure of the second system S2 is almost same as the basic structure of the first system S1. Therefore, for components of the second system S2, same reference numerals are assigned to components which are same as in the first system S1, and the description to be repeated is omitted. However, regarding the pump unit 40*b* in the second system S2, for the sake of expediency of description, a reference numeral different from the pump unit 40*a* in the first system S1 is assigned. A 'liquid' used in the second system S2 is the ink R2, and a 'liquid jetting head' used in the second system is an ink jet head 32.

Figure 5:
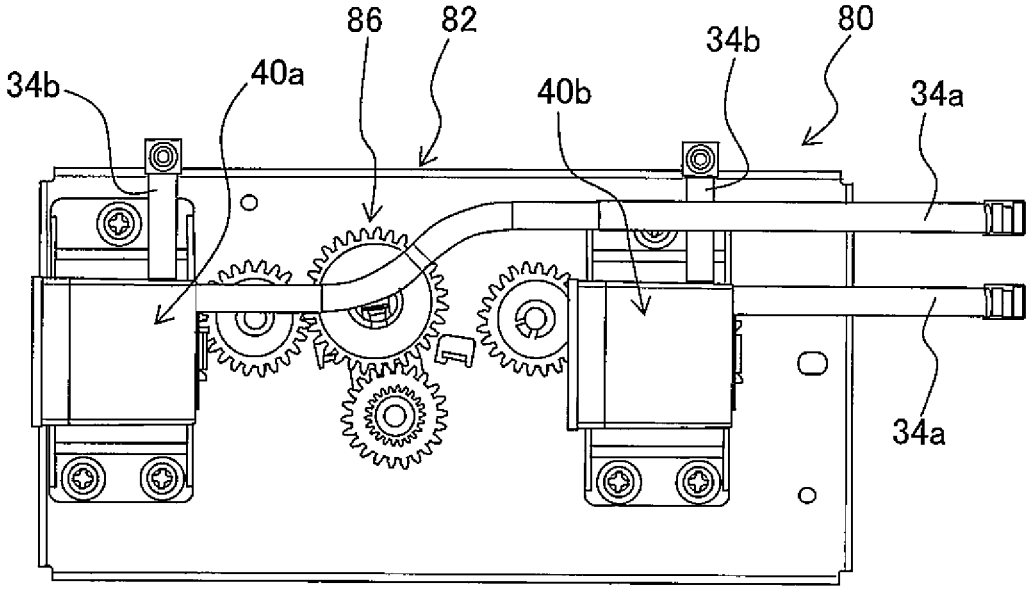
FIG. 5 is a bottom view showing a structure of a gear unit in the pump assembly.

In FIG. 5, for showing the gear unit 86 clearly, a motor 84 and a part of a base 82 are omitted.

Figure 4:
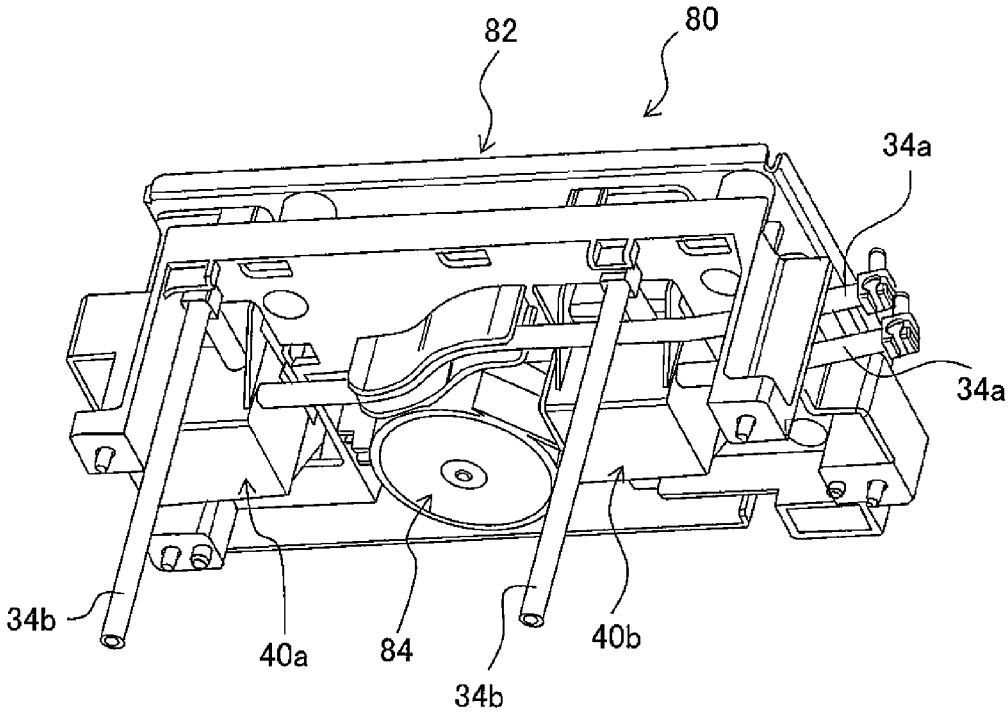
FIG. 4 is a perspective view showing an overall structure of a pump assembly.

As shown in FIG. 4, the pump assembly 80 includes the pump unit 40*a* of the first system S1, the pump unit 40*b* of the second system S2, the base 82 which supports the pump units 40*a* and 40*b*, and the motor 84 which is used in common for the pump units 40*a* and 40*b*. Moreover, as shown in FIG. 5, the pump assembly 80 includes the gear unit 86 which transmits driving force of the motor 84 (FIG. 4) to one of the pump units 40*a* and 40*b* selectively. In other words, an arrangement is made such that the pump unit 40*a* of the first system S1 and the pump unit 40*b* of the second system S2 are driven selectively by the motor 84 which is in common Consequently, in the embodiment, when the pump unit 40*a* of the first system S1 is driven, the motor 84 functions as a part of the pump unit 40*a*, and when the pump unit 40*b* of the second system S2 is driven, the motor 84 functions as a part of the pump unit 40*b*. The motor 84 may not be used selectively in the first system S1 and the second system S2. For instance, as the motor 84, two motors for the first system S1 and the second system S2 may be used.

A concrete structure of the pump unit 40*a* of the first system S1 is almost same as a concrete structure of the pump unit 40*b* of the second system S2. Therefore, only the pump unit 40*a* of the first system S1 will be described below. When the pump unit 40*a* of the first system Si is driven, the motor 84 functions as a part of the pump unit 40*a*. However, in diagrams from FIG. 6 to FIG. 9, the motor 84 is omitted. Moreover, in FIG. 6, a lid portion 100 of a first chamber 90 (FIG. 8) and a lid portion 110 of a second chamber 92 (FIG. 8) are omitted.

Figure 6:
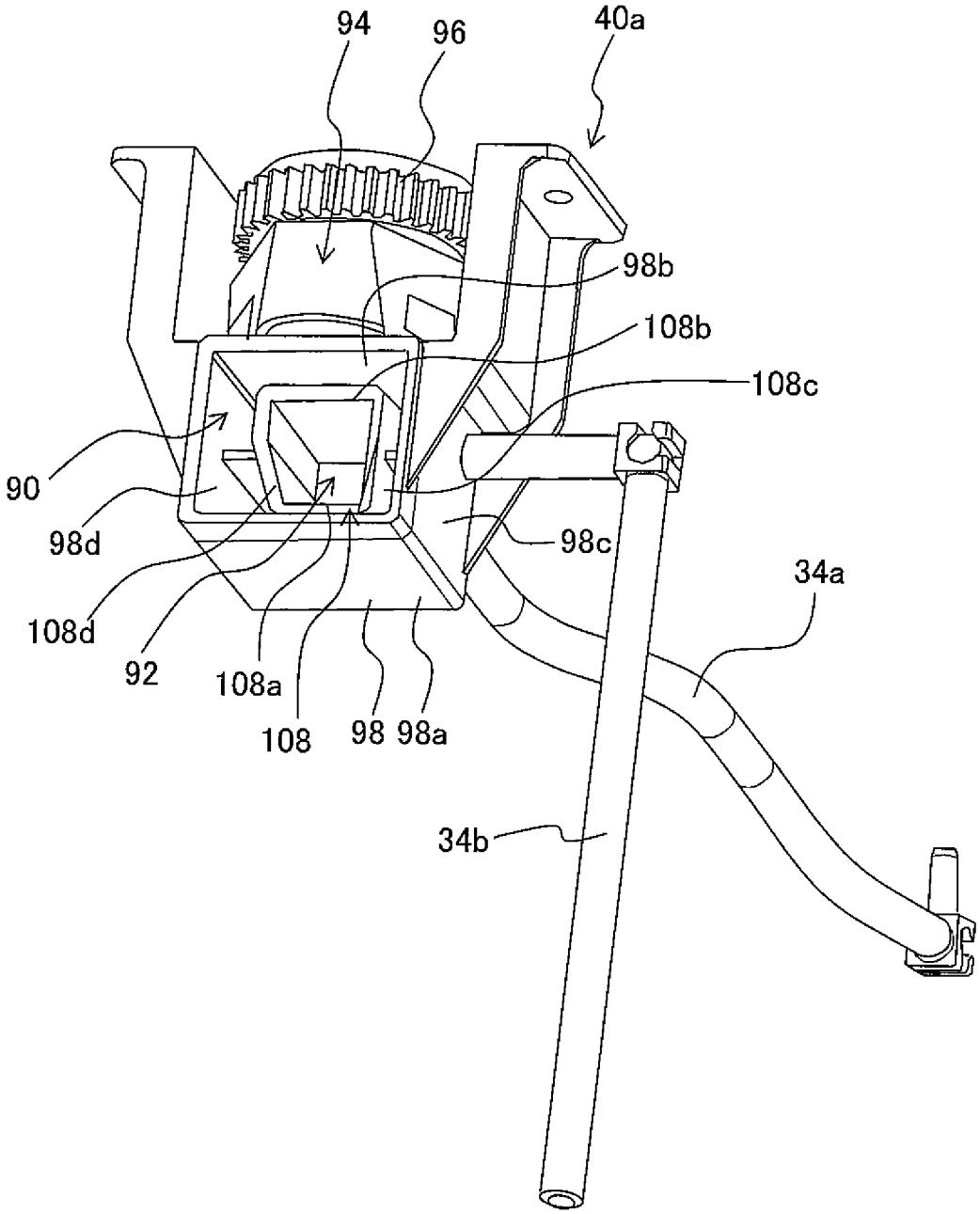
FIG. 6 is a perspective view showing a structure of main components of a pump unit.
Figure 7:
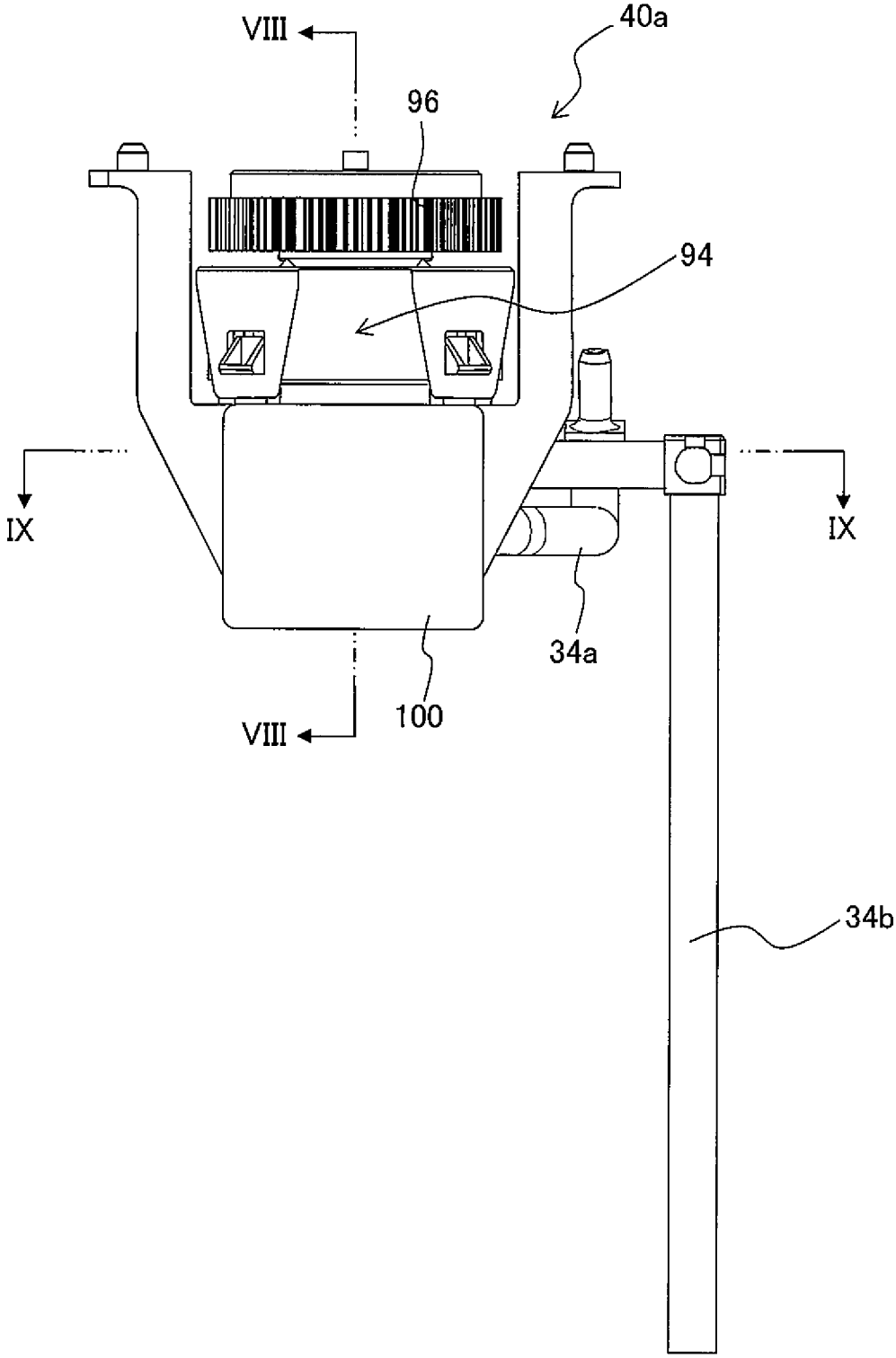
FIG. 7 is a side view showing a structure of the main components of the pump unit.

As shown in FIG. 6, the pump unit 40*a* has the first chamber 90, the second chamber 92, a diaphragm pump 94 as a plurality of transfer-force applying sections which apply a transfer-force for transferring the processing liquid R1 in the first chamber 90 to the second chamber 92, a gear 96 which forms a part of the gear unit 86 as shown in FIG. 5, and the motor 84 as shown in FIG. 4.

Figure 8:
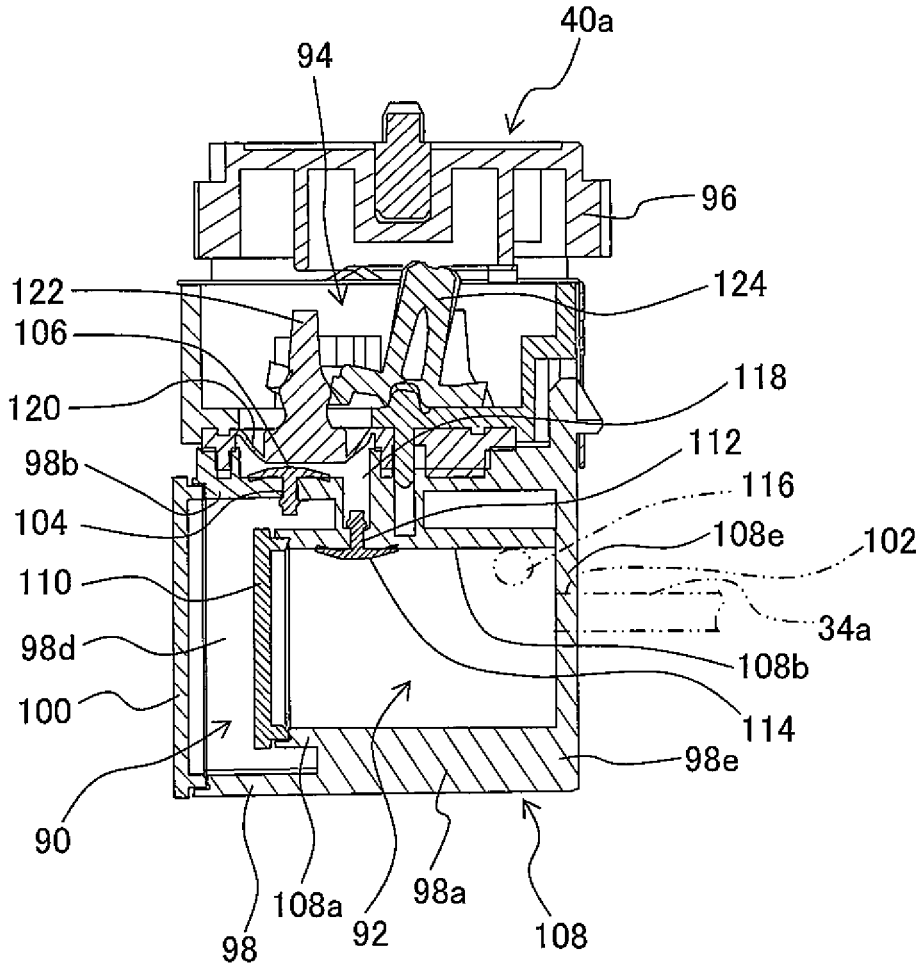
FIG. 8 is a cross-sectional view taken along a line VIII-VIII in FIG. 7.

As shown in FIG. 9, the first chamber 90 has a main-body 98 which is substantially box-shaped, and the lid portion 100 which is in the form of a substantially quadrangular-shaped plate. As shown in FIG. 6, the main-body portion 98 has a bottom-plate portion 98*a* and a top-plate portion 98*b* which face each other in a vertical direction, a first side-plate portion 98*c* and a second side-plate portion 98*d* which face each other in a horizontal direction, and a third side-plate portion 98*e* (refer to FIG. 8) which is at right angles to the first side-plate portion 98*c* and the second side-plate portion 98*d*. As shown in FIG. 8, the lid portion 100 is arranged on a side surface facing the third side-plate portion 98*e*. Moreover, as shown in FIG. 9, the first chamber inlet 102 is formed in the third side-plate portion 98*e*, and the downstream-side end portion of the upstream-side supply channel 34*a* is connected to the first chamber inlet 102. As shown in FIG. 8 and FIG. 9, three first chamber outlets 104 are formed in the top-plate portion 98*b* which is positioned at an upper-end portion of the first chamber in the vertical direction and, a check valve 106 which allows only a discharge of the processing liquid R1 or air under predetermined conditions is installed in each first chamber outlet 104. In the embodiment, three first chamber outlets 104 are formed in the top-plate portion 98*b*. However, such an arrangement is merely an exemplification, and two first chamber outlets 104 or not less than four first chamber outlets 104 may be formed. The first chamber outlet 104 shown in FIG. 9 is an outlet which is positioned at an upper side of the cross-section, and is not visible practically.

As shown in FIG. 9, the second chamber 92 is a chamber which is arranged at an interior (at an inner side) of the first chamber 90, and is defined by a main-body 108 which is substantially box-shaped, and a lid portion 110 which is in the farm of a substantially quadrangular-shaped plate. As shown in FIG. 6, the main-body 108 has a bottom-plate portion 108*a* and a top-plate portion 108*b* which face each other in the vertical direction, a first side-plate portion 108*c* and a second side-plate portion 108*d* which face each other in the horizontal direction, and a third side-plate portion 108*e* (refer to FIG. 8) which is arranged to be orthogonal to the first side-plate portion 108*c* and the second side-plate portion 108*d*. As shown in FIG. 8, the lid portion 110 is arranged on a side surface facing the third side-plate portion 108*e*. Moreover, as shown in FIG. 8 and FIG. 9, three second chamber inlets 112 are formed in the top-plate portion 108*b* of the second chamber 92, and a check valve 114 which allows only entry of the processing liquid R1 or air under predetermined conditions is installed in each second chamber inlet 112. Moreover, as shown in FIG. 9, a second chamber outlet 116 is formed in a portion of the first side-plate portion 108*c*, positioned at an upper-end portion in the vertical direction of the second chamber 92. The upstream-side end portion of the downstream-side supply channel 34*b* is connected to the second chamber outlet 116. Here, in the embodiment, an arrangement in which three second chamber inlets 112 are formed in the top-plate portion 108*b* is shown. However, such an arrangement is merely an exemplification. For instance, two second chamber inlets 112 or not less than four second chamber inlets 112 may be formed in the top-plate portion 108*b*. The second chamber inlet 112 shown in FIG. 9 is an inlet which is positioned at an upper side of the cross-section, and not visible practically.

As shown in FIG. 8, the three diaphragm pumps 94 have a pressure applying chamber 118 which is arranged between the first chamber outlet 104 and the second chamber inlet 112 corresponding to the first chamber outlet 104, and both the first chamber outlet 104 and the second chamber inlet 112 are connected to the pressure applying chamber 118 (the diaphragm pump 94). In other words, the pressure applying chamber 118 communicates with the first chamber 90 via the first chamber outlet 104, and also, communicates with the second chamber 92 via the second chamber inlet 112. A ceiling portion of the pressure applying chamber 118 is formed by a diaphragm 120 which is flexible, in order to apply a pressure to the processing liquid R1 or air inside the pressure applying chamber 118. A central portion of an upper surface of the diaphragm 120 is provided with a supporting portion 122 in the form of a protrusion (projection) which supports the central portion of the diaphragm 120. Moreover, to each of the three supporting portions 122, an operating section 124 which makes the supporting portion 122 displace vertically in a different phase is connected. The gear 96 which applies a driving force to the operating portion 124 is arranged at an upper side of the operating portion 124. In the embodiment, an arrangement in which the pump unit 40*a* includes three diaphragm pumps 94 and three supporting portions 122 has been shown. However, such an arrangement is merely an exemplification. For instance, the pump unit 40*a* may include two diaphragm pumps 94 and two supporting portions 122, or four or more diaphragm pumps 94 and four or more supporting portions 122.

As shown in FIG. 9, the three diaphragm pumps 94 are arranged to be separated at an angle of 120 degrees around a central shaft of the gear 96 (refer to FIG. 8). Consequently, as a rotational force of the motor 84 (FIG. 4) is transmitted to the operating portion 124 via the gear 96 (FIG. 8), the three diaphragm pumps 94 are driven with a phase difference of 120 degrees, and an ascending up and descending down of the diaphragm 120 is repeated. As the diaphragm 120 ascends up, a negative pressure is applied to the processing liquid R1 or air in the pressure applying chamber 118, thereby opening the check valve 106, and the processing liquid R1 or air inside the first chamber 90 is supplied to the pressure applying chamber 118 through the first chamber outlet 104. Whereas, as the diaphragm 120 descends down, a positive pressure is applied to the processing liquid R1 or air in the pressure applying chamber 118, thereby opening the check valve 114, and the processing liquid R1 or air inside the pressure applying chamber 118 is supplied to the second chamber 92 through the second chamber inlet 112. By such an operation of the diaphragm pump 94, the processing liquid R1 or air in the first chamber 90 which has been sucked in order through the three first chamber outlets 104 are imparted to the second chamber in order through the three second chamber inlets 112. A three-phase transfer-force applying section is formed by the three-phase diaphragm pumps 94.

In the ink-jet printer 10 shown in FIG. 1, after the ink jet printer 10 is shipped from the factory, at the time of installing the main tank 26 on the tank holder 28 for the first time, or at the time of replacing the emptied main tank 26 to a new main tank 26, there is a possibility that air flows into the first liquid supply channel 34 from the upstream-side end portion.

Figure 10:
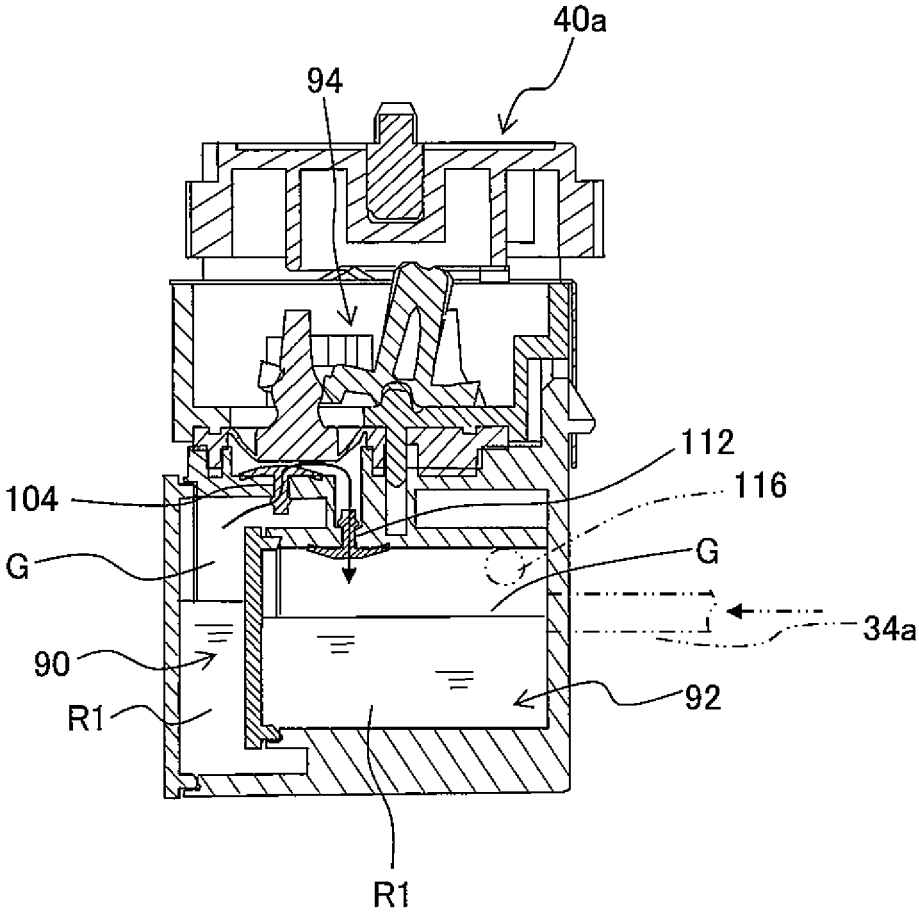
FIG. 10 is cross-sectional view corresponding to FIG. 8 showing an air transfer operation of the pump unit.

As shown in FIG. 10, in such circumstances, when the diaphragm pump 94 of the pump unit 40*a* is driven by the motor 84, the processing liquid (liquid) R1 which has been imparted to the first chamber 90 accumulates at a lower portion (bottom) of the first chamber 90, and air G which has been imparted to the first chamber 90 accumulates at an upper portion (top) of the first chamber 90. Moreover, the processing liquid (liquid) R1 which has been imparted to the second chamber 92 accumulates at a lower portion (bottom) of the second chamber 92, and air G which has been imparted to the second chamber 92 accumulates at an upper portion (top) of the second chamber 92. Consequently, when the diaphragm pump 94 is driven further, firstly, the air G which has been accumulated at the upper portion of the first chamber 90, upon being discharged through the first chamber outlet 104 provided to an upper-end portion of the first chamber 90, is imparted to the second chamber 92, and at the same time, the air G which has been accumulated at the upper portion of the second chamber 92, upon being discharged through the second chamber outlet 116 provided to an upper-end portion of the second chamber 92, is imparted to the sub tank 30 shown in FIG. 1.

Figure 11:
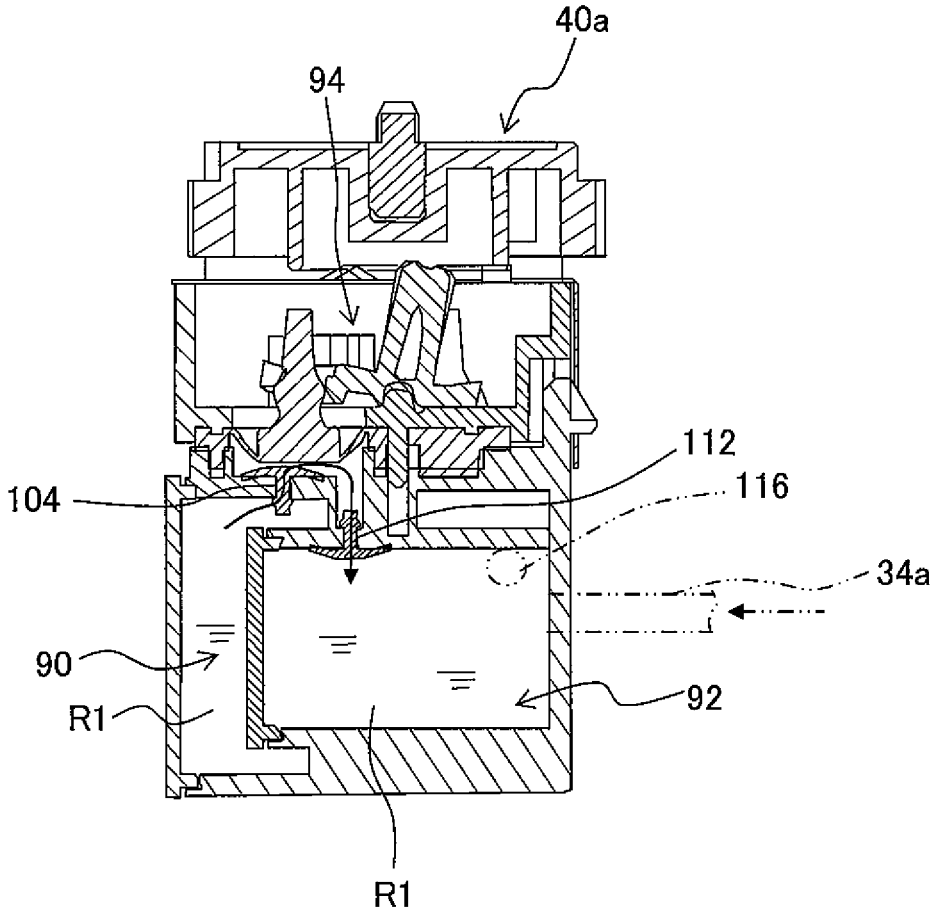
FIG. 11 is a cross-sectional view corresponding to FIG. 8 showing a liquid transfer operation of the pump unit.

As shown in FIG. 11, as the air G in the first chamber 90 is discharged completely and the first chamber 90 is filled up with the processing liquid (liquid) R1, thereafter, the processing liquid (liquid) R1 in the first chamber 90, upon being discharged through the first chamber outlet 104 provided to the upper-end portion of the first chamber 90, is imparted to the second chamber 92. Moreover, as the air G in the second chamber 92 is discharged completely and the second chamber 92 is filled up with the processing liquid (fluid) R1, thereafter, the processing liquid (fluid) R1 in the second chamber 92, upon being discharged through the second chamber outlet 116 provided to the upper-end portion of the second chamber 92, is imparted to the sub tank 30.

The control device 14 shown in FIG. 1 controls the diaphragm pump 94 to change a driving speed of the diaphragm pump 94. In other words, the control device 14 drives the diaphragm pump 94 at an optimum driving speed according to factors such as a type of the liquid and a timing of driving the diaphragm pump 94.

For instance, in a case in which the liquid (processing liquid R1 and the ink R2) is of a type such that air bubbles are susceptible to be developed (generated), the control device 14 controls the diaphragm pump 94 to slow down (to reduce) the driving speed of the diaphragm pump 94. Accordingly, it is possible to suppress generation of air bubbles. Whereas, in a case in which the liquid is of a type such that air bubbles are not generated easily, the control device 14 controls the diaphragm pump 94 to increase the driving speed of the diaphragm pump 94. Accordingly, it is possible to carry out the supply of the liquid to the sub tank 30 (FIG. 1) promptly. Moreover, at an initial stage immediately after the main tank 26 (FIG. 1) has been installed on the tank holder 28, the control device controls the diaphragm pump 94 to slow down the driving speed of the diaphragm pump 94. At the initial stage, there is a possibility that a large amount of air exists in the first chamber 90. However, by controlling the diaphragm pump 94 to slow down the driving speed of the diaphragm pump 94, it is possible to suppress stirring of air and the liquid.

Moreover, the control device 14 shown in FIG. 1 controls the diaphragm pumps 94 such that, the driving speed of the diaphragm pump 94 in the first pump unit 46*a* and the driving speed of the diaphragm pump 94 in the second pump unit 46*b* differ. Consequently, even when it is a case in which the type of liquids (processing liquid R1 and ink R2) in the first system S1 and the second system S2 differs, it is possible to select the optimum driving speed corresponding to (suitable for) the type of the liquid (processing liquid R1 and ink R2).

[Effect of Embodiment]

In the embodiment, it is possible to show the following effect due to the abovementioned arrangement. An effect achieved by the pump unit 40*a* of the first system S1 which is described below is similar to an effect achieved by the pump unit 40*b* of the second system S2.

As shown in FIG. 8, the first chamber outlet 104 of the pump unit 40*a* is provided to the upper-end portion of the first chamber 90 in the vertical direction, and the second chamber outlet 116 is provided to the upper-end portion of the second chamber 92 in the vertical direction. Therefore, as shown in FIG. 10 and FIG. 11, it is possible to transfer the air G and the processing liquid (liquid) R1 one after another by the diaphragm pump 94. Consequently, it is possible to suppress the air bubbles supplied to the processing liquid jetting head 32 and the sub tank 30 shown in FIG. 1 without the air G and the processing liquid (liquid) R1 being stirred intensively, and it is possible to prevent a jetting defect which may be caused due to air bubbles.

As shown in FIG. 8, since the pump unit 40*a* includes the diaphragm pump 94 which does not have a rotating blade, it is possible to suppress the stirring of the air G and the processing liquid (liquid) R1, and to prevent the mixing of air bubbles with the processing liquid (liquid) R1.

As shown in FIG. 9, since the plurality of transfer-force applying sections is formed by the plurality of diaphragm pumps 94, it is possible to stabilize the operation of the pump unit 40*a*.

As shown in FIG. 9, since the first chamber 90 is arranged to enclose (surround) the second chamber 92 when the pump unit 40*a* is seen in a plan view, it is possible to form the pump unit 40*a* compactly.

[Other Embodiments]

As shown in FIG. 4, in the embodiment described above, the pump unit 40*a* of the first system S1 and the pump unit 40*b* of the second system S2 are arranged to be driven selectively by the motor 84 in common. However, in the other embodiment, the pump unit 40*a* and the pump unit 40*b* may be driven by two different separate motors. Moreover, as the 'transfer-force applying section', another type of pump other than a diaphragm pump may be used instead of the diaphragm pump 94.

As shown in FIG. 9, in the embodiment described above, for structuring the pump unit 40*a* compactly, the first chamber 90 is arranged to enclose the second chamber 92. However, the first chamber 90 and the second chamber 92 may be arranged such that one of the first chamber 90 and the second chamber 92 is arranged at an inner side, and the other one is arranged at an outer side. For instance, the second chamber 92 may be arranged to enclose the first chamber 90.

As shown in FIG. 1, in the embodiment described above, the 'liquid ejecting apparatus' according to the present teaching is applied to a single-color line printer. However, in other embodiments, the 'liquid ejecting apparatus' according to the present teaching may be applied to a color line printer or a serial printer. Moreover, in the embodiment described above, the 'liquid ejecting apparatus' according to the present teaching is applied to an ink jet printer. However, in the other embodiments, the 'liquid ejecting apparatus' according to the present invention may be applied to a liquid ejecting apparatus other than printer such as a facsimile and a copy machine. Furthermore, as a liquid jetting type, a type in which a liquid is jetted by using a pressure when a volume of the liquid is increased by a heater element, may be used instead of an actuator type.

What is claimed is:

1. A liquid ejecting apparatus comprising:

a main tank configured to store the liquid;

a sub tank having an atmosphere-communicating hole formed therein, and configured to store temporarily the liquid supplied from the main tank;

a liquid ejecting head having a plurality of nozzles for ejecting the liquid supplied from the main tank;

a first supply channel member having a first liquid supply channel communicating between the main tank and the sub tank;

a second supply channel member having a second liquid supply channel communicating between the sub tank and the liquid ejecting head; and a pump device provided to the first liquid supply channel, and configured to supply the liquid in the main tank to the sub tank, wherein the first liquid supply channel includes an upstream-side supply channel arranged toward a main-tank side of the pump device, and a downstream-side supply channel arranged toward a sub-tank side of the pump device, the pump device includes a first chamber in which a first chamber inlet and a first chamber outlet are formed, a second chamber in which a second chamber inlet and a second chamber outlet are formed, and a transfer-force applying section which is configured to apply a transfer force for transferring a liquid inside the first chamber to the second chamber, the first chamber inlet is connected to a downstream-side end portion of the upstream-side supply channel, the first chamber outlet and the second chamber inlet are connected to the transfer-force applying section, the second chamber outlet is connected to an upstream-side end portion of the downstream-side supply channel, the first chamber outlet is provided to an upper-end portion of the first chamber, in a vertical direction, and the second chamber outlet is provided to an upper-end portion of the second chamber, in the vertical direction.

2. The liquid ejecting apparatus according to claim 1, further comprising:

a control device configured to control the transfer-force applying section, wherein the first chamber outlet is formed as a plurality of first chamber outlets, at an upper-end portion of the first chamber in the vertical direction, the second chamber inlet is formed as a plurality of second chamber inlets corresponding to the plurality of first chamber outlets, at an upper-end portion of the second chamber in the vertical direction, the transfer-force applying section is arranged as a plurality of transfer-force applying sections, between the plurality of first chamber outlets and the plurality of second chamber inlets corresponding to the plurality of first chamber outlets, and the control device is configured to drive the plurality of transfer-force applying section at mutually different phases.

3. The liquid ejecting apparatus according to claim 1, wherein the transfer-force applying section is a diaphragm pump.

4. The liquid ejecting apparatus according to claim 1, wherein one of the first chamber and the second chamber is arranged to surround the other of the first chamber and the second chamber in a vertical plane.

5. The liquid ejecting apparatus according to claim 1, further comprising a control device configured to control the transfer-force applying section, wherein the control device is configured to change a driving speed of the transfer-force applying section.

6. The liquid ejecting apparatus according to claim 5, wherein in an initial stage immediately after the main tank has been installed, the control device controls the transfer-force applying section to slow down the driving speed of the transfer-force applying section.

7. The liquid ejecting apparatus according to claim 1, further comprising a control device configured to control the transfer-force applying section;

wherein the main tank includes a first main tank and a second main tank, the sub tank includes a first sub tank and a second sub tank, the liquid ejecting head includes a first liquid ejecting head and a second liquid ejecting head, the pump device includes a first pump and a second pump, the first supply channel member includes a primary first supply channel member and a secondary first supply channel member, the second supply channel member includes a primary second supply channel member and a secondary second supply channel member, and the liquid ejecting apparatus further includes:

a first system including the first main tank, the first sub tank, the first liquid ejecting head, the first liquid supply channel which is formed in the primary first supply channel member, and the second liquid supply channel which is formed in the primary second supply channel member, and the first pump, and a second system including the second main tank, the second sub tank, the second liquid ejecting head, the first liquid supply channel which is formed in the secondary first supply channel member, the second liquid supply channel which is formed in the secondary second supply channel member, and the second pump, and the control device controls the transfer-force applying section of the first pump and the transfer-force applying section of the second pump such that the respective driving speeds differ.

8. The liquid ejecting apparatus according to claim 1, wherein the pump device includes a first pump and a second pump, and the liquid ejecting apparatus further comprising: a motor which has been provided in common to the first pump and the second pump; and a power transmission mechanism which is arranged to transmit a driving force of the motor by switching to the first pump and the second pump.

9. The liquid ejecting apparatus according to claim 1, further comprising a control device configured to control the transfer-force applying section, wherein the transfer-force applying section of the pump device has three diaphragm pumps, and the control device drives the three diaphragm pumps with a phase difference of 120 degrees.

* * * * *